US006257554B1

(12) United States Patent
McDonough

(10) Patent No.: US 6,257,554 B1
(45) Date of Patent: Jul. 10, 2001

(54) STAPLE REMOVER HOLDING DEVICE AND METHOD

(76) Inventor: Skip McDonough, 332 River Edge Rd., Jupiter, FL (US) 33477

( * ) Notice: Subject to any disclaimer, the term of this patent is extended or adjusted under 35 U.S.C. 154(b) by 0 days.

(21) Appl. No.: 09/460,284

(22) Filed: Dec. 9, 1999

(51) Int. Cl.[7] ..... B25C 11/00
(52) U.S. Cl. ..... 254/28; 254/1
(58) Field of Search ..... 81/57.4, 57.24, 81/180.1; 254/28; 224/254; 269/95

(56) References Cited

U.S. PATENT DOCUMENTS 5,513,833 * 5/1996 Kirk ..... 254/28
5,974,914 * 11/1999 Belanger ..... 81/57.4

* cited by examiner

*Primary Examiner*—Robert C. Watson
(74) *Attorney, Agent, or Firm*—McHale & Slavin

(57) ABSTRACT

A holder for selectively supporting a staple remover comprises a housing sleeve, an adjustable tethering member, means for retracting the tethering member from a use orientation into a retrieval orientation, and an attachment member for mounting the housing sleeve to an anchor surface. The housing sleeve includes a receiving chamber sized and shaped to accommodate a staple remover, and a positioning notch disposed within the housing sleeve maintains the staple remover in a dispensing orientation within the receiving chamber between uses. The means for retracting the tethering member automatically draws the staple remover into the receiving chamber, and cooperates with the positioning notch to automatically orient the staple remover in the dispensing orientation.

4 Claims, 2 Drawing Sheets

STAPLE REMOVER HOLDING DEVICE AND METHOD

FIELD OF THE INVENTION

This invention is directed to storage devices and, in particular, to a device suited for movably connecting a staple remover to a selected anchoring location.

BACKGROUND OF THE INVENTION

Hand-held tools are used in a variety of settings. By their nature, these tools are often small and easy to misplace. Accordingly, numerous devices have been developed to help keep tools in ready-to-retrieve locations.

In some situations, individuals wish to transport tools with them as they travel about. Several clip-mounted carrying devices allow items to be carried easily from place to place, without encumbering an individual's hands during periods of non-use. U.S. Pat. No. 5,230,117 provides an example of this type of device. The '117 device is a golf shoe and golf club cleaning device including a brush that is tethered to a golf bag by spring-loaded cable. The cable retracts into a casing that is removably clipped to a selected golf club bag. Although this type of device may attach a cleaning brush to a golf club bag, the device does not maintain the brush in a preferred orientation with respect to the bag and allows the brush to sway during periods of non-use.

In other situations, transportation of a selected tool is actually undesirable, and movably anchoring the tool is appropriate. U.S. Pat. No. 1,963,326 provides an example of tool securing device for use in these situations. The '326 device discloses an eraser and an associated retrieving device. The '326 device includes a spring-loaded winding reel having an automatic position lock that prevents unwanted retrieval of played out tethering line. The '326 device also includes a suction cup that allows the device to be removably attached to smooth, flat surfaces, such as the exterior of a typewriter. With this arrangement, the '326 allows an eraser to be removably tethered to a typewriter for use while typing a document. Although the '326 device will automatically retrieve an attached eraser and includes a position lock, the '326 device does not position and maintain the retracted eraser in a preferred orientation with respect to the anchoring typewriter.

In other situations, it may be desirable to collect a group of similar tools, such as remote control units, at one central location. Several devices have been designed to movably anchor and organize several devices in this manner. U.S. Pat. No. 4,735,377 discloses an example of this type of device. The '377 device discloses a remote control holder that includes a spring recoil mechanism to extendably tether at least one remote control unit to a movable base. In one embodiment, the '377 device includes several discrete holder regions into which attached remote control units may be placed, allowing organization of the units according to operator preference. Although the '377 device includes discrete holding regions for attached remote control units, the device does not automatically guide the attached remote control units into the corresponding regions.

Thus, what is needed is a tethering and storage device that includes advantages of the known devices, while addressing the shortcomings they exhibit. The device should movably link a staple remover to a selected anchoring surface. The device should also automatically draw an attached staple remover into a housing sleeve after each use. And, the device should automatically guide the staple remover into a safe, easy-to-grasp retrieval or dispensing orientation and maintain the remover in the dispensing orientation in preparation for use.

SUMMARY OF THE INVENTION

The instant invention is a tethering and storage device that secures a staple remover to a selected location and maintains the staple remover in a preferred, easy-to-grasp orientation between uses. The device includes a housing sleeve having a plurality of walls that cooperatively form a receiving chamber sized and shaped to accommodate a staple remover. An attachment member, such as an adhesive pad, is mounted on the rear wall of the housing sleeve, thereby facilitating securement of the housing sleeve to a selected anchoring surface, such as the exterior of a copy machine, a tabletop, or the like.

The front wall of the main housing sleeve is characterized by a positioning aperture that engages a portion of the staple remover when the staple remove is at rest within the receiving chamber. The positioning aperture ensures that the staple remover remains in an easy-to-grasp retrieval orientation in between uses. This arrangement reduces the likelihood that an individual will inadvertently grasp the staple remover by one of the remover's staple-lifting teeth.

A flexible tethering member links the staple remover to the housing sleeve, thereby allowing the remover to be moved about within a limited distance from the anchoring location. In one embodiment, the tethering member is disposed on a spring-biased take up reel or spool mounted within the receiving chamber. As the staple remover is pulled from the receiving chamber, energy is stored within a take up reel biasing spring. When the staple remover is released, the stored energy is released, and the take up reel draws the staple remover back into the receiving chamber. The spring constant of the take up reel biasing spring may be adjusted to provide different performance characteristics. In an alternate embodiment, the tethering member is elastic and no take up reel is used.

Thus, it is an objective of the instant invention to provide a tethering and securing device for a staple remover that movably links a staple remover to a selected anchoring surface.

Still an additional objective of the present invention is to provide a tethering and securing device for a staple remover that automatically draws an attached staple remover into a housing sleeve after use.

A further objective of the present invention is to provide a tethering and securing device for a staple remover that automatically positions the staple remover in a safe, easy-to-grasp retrieval or orientation between uses.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
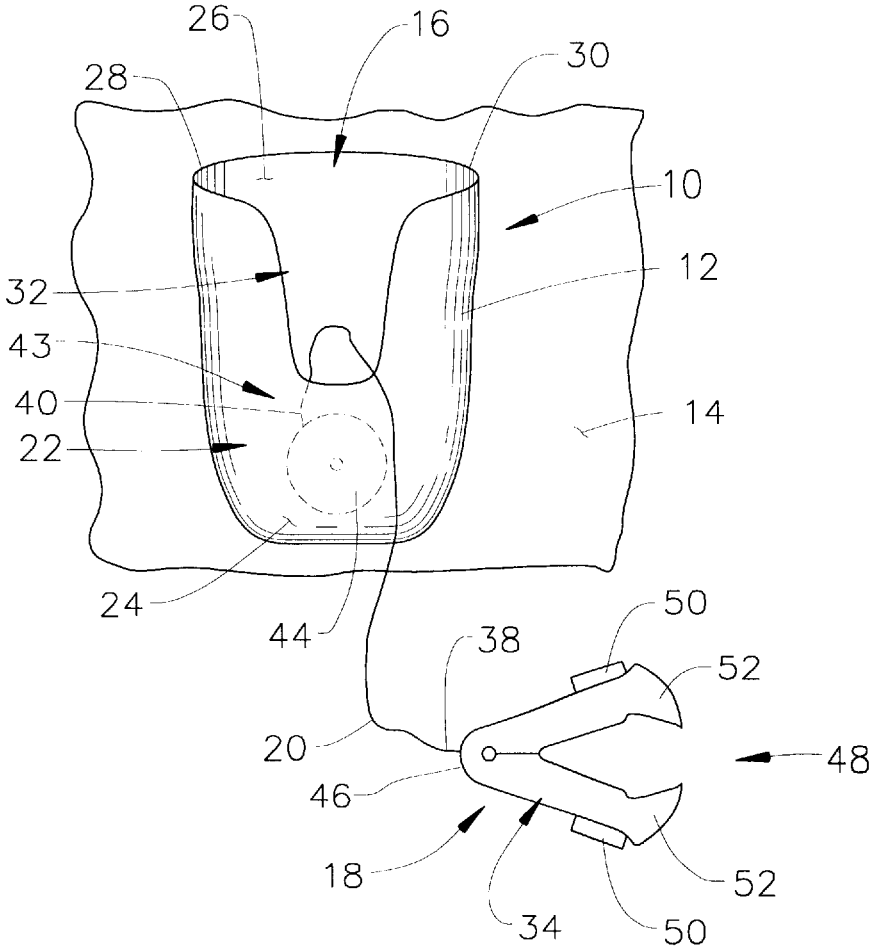
FIG. 1 is a pictorial view of the staple remover tethering and securing device of the present invention, shown attached to an anchoring surface, with an attached staple remover in a use position.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Now with reference to FIG. 1, the staple remover holder device 10 of the present invention is shown in use. By way of overview, the holder device 10 includes a housing sleeve 12 that is selectively attachable to an anchor surface 14, such as a desktop, an appliance, a wall, a computer component, and so on. The housing sleeve 12 is characterized by a receiving chamber 16 that accommodates a staple remover 18 inserted therein. With additional reference to FIG. 2, the holder device 10 includes a tethering member 20 that links the staple remover 18 to the housing sleeve 12. A retrieval means 22 disposed within the receiving chamber 16 urges the staple remover 18 attached to the tethering member 20 into the receiving chamber 16.

Figure 2:
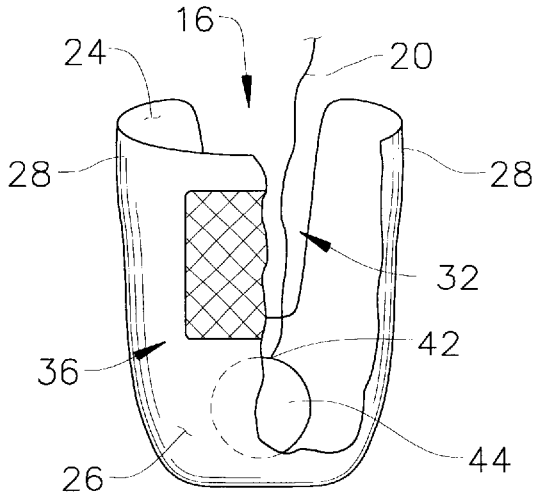
FIG. 2 is a rear perspective view of the tethering and securing device shown in FIG. 1, with a portion of the back wall broken away.

With continued reference to FIGS. 1 and 2, the housing sleeve 12 resembles a rigid pocket characterized by a front wall 24 spaced apart from a back wall 26 by a first side wall 28 and a second side wall 30. Although the front wall 24 and back wall may be formed separate from the side walls 28,30, it is preferred that the housing sleeve 12 be formed as an integrated unit. With particular reference to FIG. 1, the front wall 24 includes a positioning aperture 32 sized and shaped to maintain the staple remover 18 in a retrieval or dispensing orientation within the housing sleeve 12. The positioning aperture 32 engages the staple remover 18 and ensures that the staple remover is easy to grasp and secured in a safe manner while the staple remover is in the housing sleeve 12 during periods of non-use.

With reference to FIG. 2, the back wall 26 of housing sleeve 12 includes an attachment member 36 that secures the housing sleeve to a selected anchor surface 14, such as an exterior surface of a copier machine, for example. Other surfaces, including desks, tabletops, walls, and so on may also be chosen as an anchoring surface. With this arrangement, the holder device 10 may be conveniently mounted at a location where the staple remover 18 is likely to be needed and stored in a safe, easy-to-grasp retrieval orientation until the staple remover is needed. In one embodiment, the attachment member 36 is a portion of adhesive disposed on the housing sleeve back wall 26. The housing sleeve 12 need not be attached with adhesive, however. Other means of attachment may be used, as well. For example, pieces of hook-and-loop fastener material, magnetic plates, snaps, suction cups, screws, and so on may also be used.

With reference to FIGS. 1 and 2, the staple remover 18 is linked to the housing sleeve 12 via a flexible tethering member 20. In one embodiment, the tethering member 20 is a non-elastic cord having a proximal first end 38 attached to the staple remover 18 and a distal second end 40 attached to a tether retraction assembly 43. With particular reference to FIG. 2, the retrieval means 22 includes a tether retraction assembly 43 mounted within the receiving chamber 16 of the housing sleeve 12. More particularly, the tether retraction assembly 43 includes a spring-biased take up spool or reel 44 having a spring constant sufficient to draw the staple remover 18 into the receiving chamber 16 after use. The take up spool 44 is attached to an interior surface 44 of the front wall 24 but may be attached at various locations within the receiving chamber 16, if desired.

Figure 3:
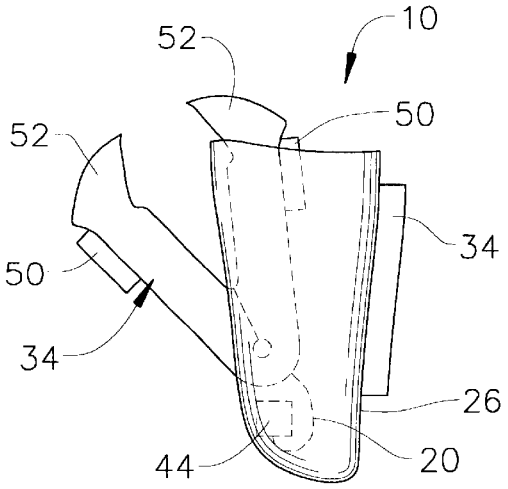
FIG. 3 is a pictorial view of the staple remover tethering and securing device of shown in FIG. 1, with an attached staple remover in a retrieval or dispensing orientation.

With this arrangement, the tether retraction assembly 43 cooperates with the positioning aperture 32 to help correctly position the staple remover 18 for the next use. That is, when the staple remover 18 is released from an individual's hand, the tether retraction assembly 43 rewinds the tethering member 20 back onto the spring-biased spool 44. As the tethering member 20 is rewound, the staple remover 18 is drawn toward the housing sleeve 12, where it comes to rest within the receiving chamber 16. As the staple remover 18 enters the receiving chamber 16, a distal end 46 of the staple remover passes through the positioning aperture 32 and a proximal end 48 of the staple remover is retained against the outside of the housing sleeve front wall 24. In this manner, the staple remover 18 is automatically guided into a dispensing or retrieval orientation, in preparation for the next use, as seen in FIG. 3.

The positioning aperture 32 ensures that the finger support tabs 50 are positioned for easy engagement by an individual's fingers, thereby reducing the likelihood that an individual will inadvertently grab the staple remover 18 by the staple lifting teeth 52. As a result, this automatic retrieval and positioning feature not only eliminates clutter, but provides ease of use and safety advantages, as well.

Figure 4:
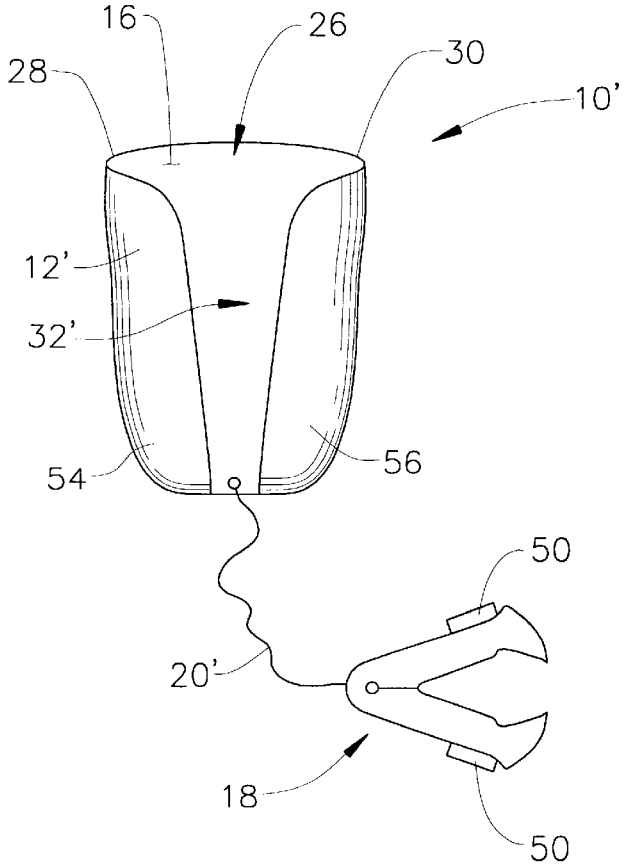
FIG. 4 is a pictorial view of an alternate embodiment of the staple remover tethering and securing device of the present invention.

It is noted that the holder device 10 of the present invention need not include a tether retraction assembly 43 to function properly. An alternate embodiment of the device 10', shown in FIG. 4, operates without a tether retraction, employing a self-retracting, elastic tethering member 20'. In this embodiment, the housing sleeve 12' may be relatively shorter and the positioning aperture 32' is bounded by a pair of cooperating front panels 54,56 that replace the housing sleeve 12 front wall 24.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

What is claimed is:

1. In combination with a staple remover, a holder for selectively supporting said staple remover, said holder comprising:

a housing sleeve forming a receiving chamber and including a rear wall spaced apart from at least one front wall by a first side wall and a second side wall;

a tethering member adapted for linking said staple remover to said housing sleeve, said tethering member being movable between a storage orientation and a use orientation;

a positioning notch disposed within said housing sleeve adapted for holding said staple remover in a dispensing orientation within respect to said housing sleeve;

retraction means for moving said tethering member from said use orientation into said retrieval orientation, said retraction means cooperating with said positioning notch to automatically place said staple remover in said dispensing orientation as said tethering member moves into said retrieval orientation; and attachment means for selectively connecting said housing sleeve to an anchor surface.

2. The holder of claim 1, wherein said retraction means includes a take up assembly disposed within a receiving chamber of said housing sleeve, said take up assembly including a biasing member having a spring constant sufficient to draw said staple remover into said dispensing orientation.

3. The holder of claim 1, wherein said retraction means includes at least one section of elastic material disposed within said tethering member.

4. A method of storing a staple remover in a dispensing orientation with respect to an anchoring surface comprising the steps of:

a) providing a holder for selectively supporting said staple remover, said holder including a housing sleeve including a rear wall spaced apart from at least one front wall by a first side wall and a second side wall; a tethering member adapted for linking said staple remover to said housing sleeve, said tethering member being movable between a storage orientation and a use orientation; a positioning notch disposed within said housing sleeve adapted for holding said staple remover in a dispensing orientation within respect to said housing sleeve; retraction means for moving said tethering member from said use orientation into said retrieval orientation, said retraction means cooperating with said positioning notch to automatically place said staple remover in said dispensing orientation as said tethering member moves into said retrieval orientation; and attachment means for selectively connecting said housing sleeve to an anchor surface;

b) connecting said housing sleeve to said housing sleeve to said anchoring surface via said attachment means; and c) operating said retraction means to removably place staple remover into said dispensing orientation.

* * * * *